US005220897A

United States Patent [19]

Buchalla et al.

[11] Patent Number: 5,220,897

[45] Date of Patent: Jun. 22, 1993

[54] APPARATUS FOR THE CONTROLLED FEEDING OF VOLATILE FUEL COMPONENTS TO THE INTAKE OF AN INTERNAL COMBUSTION ENGINE

[75] Inventors: Harald Buchalla, Darmstadt; Stefan Burger, Weinheim; Rainer Franz, Mannheim; Joachim Heinemann, Weinheim; Reinhard Tinz, Biberau, all of Fed. Rep. of Germany

[73] Assignee: Firma Carl Freudenberg, Weinheim, Fed. Rep. of Germany

[21] Appl. No.: 819,725

[22] Filed: Jan. 13, 1992

[30] Foreign Application Priority Data

Jan. 11, 1991 [DE] Fed. Rep. of Germany ..... 4100659

[51] Int. Cl.[5] ..... F02M 33/02

[52] U.S. Cl. ..... 123/520; 123/198 D; 123/494

[58] Field of Search ..... 123/516, 518, 519, 520, 123/521, 198 D, 494

[56] References Cited

U.S. PATENT DOCUMENTS

| | | | |
|---|---|---|---|
| 4,748,959 | 6/1988 | Cook | 123/520 |
| 4,862,856 | 9/1989 | Yokoe | 123/519 |
| 4,886,026 | 12/1989 | Cook | 123/520 |
| 4,901,702 | 2/1990 | Beicht | 123/520 |
| 4,949,695 | 8/1990 | Uranishi | 123/520 |
| 4,953,514 | 9/1990 | Beicht | 123/520 |
| 4,962,744 | 10/1990 | Uranishi | 123/520 |
| 5,054,454 | 10/1991 | Hamburg | 123/520 |
| 5,080,078 | 1/1992 | Hamburg | 123/519 |

FOREIGN PATENT DOCUMENTS 3909887 9/1990 Fed. Rep. of Germany .

*Primary Examiner*—Carl S. Miller
*Attorney, Agent, or Firm*—Felfe & Lynch

[57] ABSTRACT

A line (3) provided between the head space (11) of the fuel tank (10) and the induction tube (1) of the engine contains an absorption element (9) and can be shut off by a signal-actuated servo valve (8) connected to the outlet from the absorption element. The line (3) is provided with a first sensor (4) preceding the absorption element (9) and detecting gas flows. A vacuum actuator (12) following the servo valve (8) is provided with a second sensor (13) which gives a signal when actuated. The first sensor (4) and the second sensor (13) are connected for carrying signals to a diagnosis block (14) which compares them with the signal (17) actuating the servo valve (8) and uses them for fault diagnosis.

4 Claims, 4 Drawing Sheets

APPARATUS FOR THE CONTROLLED FEEDING OF VOLATILE FUEL COMPONENTS TO THE INTAKE OF AN INTERNAL COMBUSTION ENGINE

BACKGROUND OF THE INVENTION

The invention relates to an apparatus for the temporary storage and controlled feeding of volatile fuel components contained in the head space of a fuel tank system into the intake tube of an internal combustion engine. A line provided between the head space and the induction tube contains an absorption element and can be shut off by a signal-actuated servo valve connected to the output from the absorption element. The servo valve has an admittance which is variable by a vacuum actuator and can be actuated by the signal from a diagnosis block which processes data relating to the state of operation of the internal combustion engine.

Such an apparatus is disclosed in DE-OS 3909887, which describes a method for checking the functionality of a tank venting valve by which the air charged with fuel vapors can be fed to the intake of an internal combustion engine. For the practice of this method, factors are measured at the tank venting valve, such as pressure, mass flow or volumetric flow of volatile fuel components through a line. Provision is made for sensors to precede as well as follow the tank venting valve (in the direction of movement of the volatile fuel components), each sensor carrying signals to a diagnosis block. The data entering the microprocessor are preferably processed by determining differences. Irregularities affecting the controllability of the tank venting valve are made visible in a display if they exceed an established tolerance.

However, it is to be noted that monitoring the controllability of the tank venting valve is made possible by means of a sensing system that is delicate as well as not very satisfactory from the economic point of view, which is used in addition to system components that already exist.

The invention is addressed to the problem of improving an apparatus of the kind described above so as not to use a high-cost and delicate sensing system, but to resort insofar as possible to available signals and to accomplish this by the simple modification of available system components, thus achieving considerable savings while improving performance.

SUMMARY OF THE INVENTION

Provision is made for providing the line running between the free space of the tank system and the induction tube with a first sensor preceding the absorption element and sensing gas flows. The vacuum actuator is provided with a second sensor which gives a signal when actuated. The first and second sensors are connected to carry signals to the diagnosis block, and the two signals of the sensors are compared in the diagnosis block with the signal actuating the servo valve and are used for the diagnosis of errors.

The apparatus permits monitoring the controlled feeding of volatile fuel components into the induction tube of an internal combustion engine. The basic components of the apparatus are disclosed in U.S. Pat. No. 4,901,702, incorporated herein by reference, and are supplemented in the present invention essentially by the following components. In a diagnosis block connected so as to receive signals both from the apparatus and from the internal combustion engine, the data necessary for establishing the set value of the volatile components through the line into the engine are brought together. These are especially data which describe the loading of the engine, such as the position of the throttle valve or of a comparable device, and the rotatory speed of the engine. The current values, which are also fed to the diagnosis block, originate from a vacuum actuator which is provided with an integrated circuit that describes its state. The second input signal describing the current value consists of a valve unit with an integrated electrical contact which is preferably in the form of a tank venting valve. By means of the vacuum actuator with switching element the pressure level in the line to the engine is measured between the absorption element and the connection to the induction tube of the engine.

DETAILED DESCRIPTION OF THE PREFERRED EMBODIMENT

Figure 1:
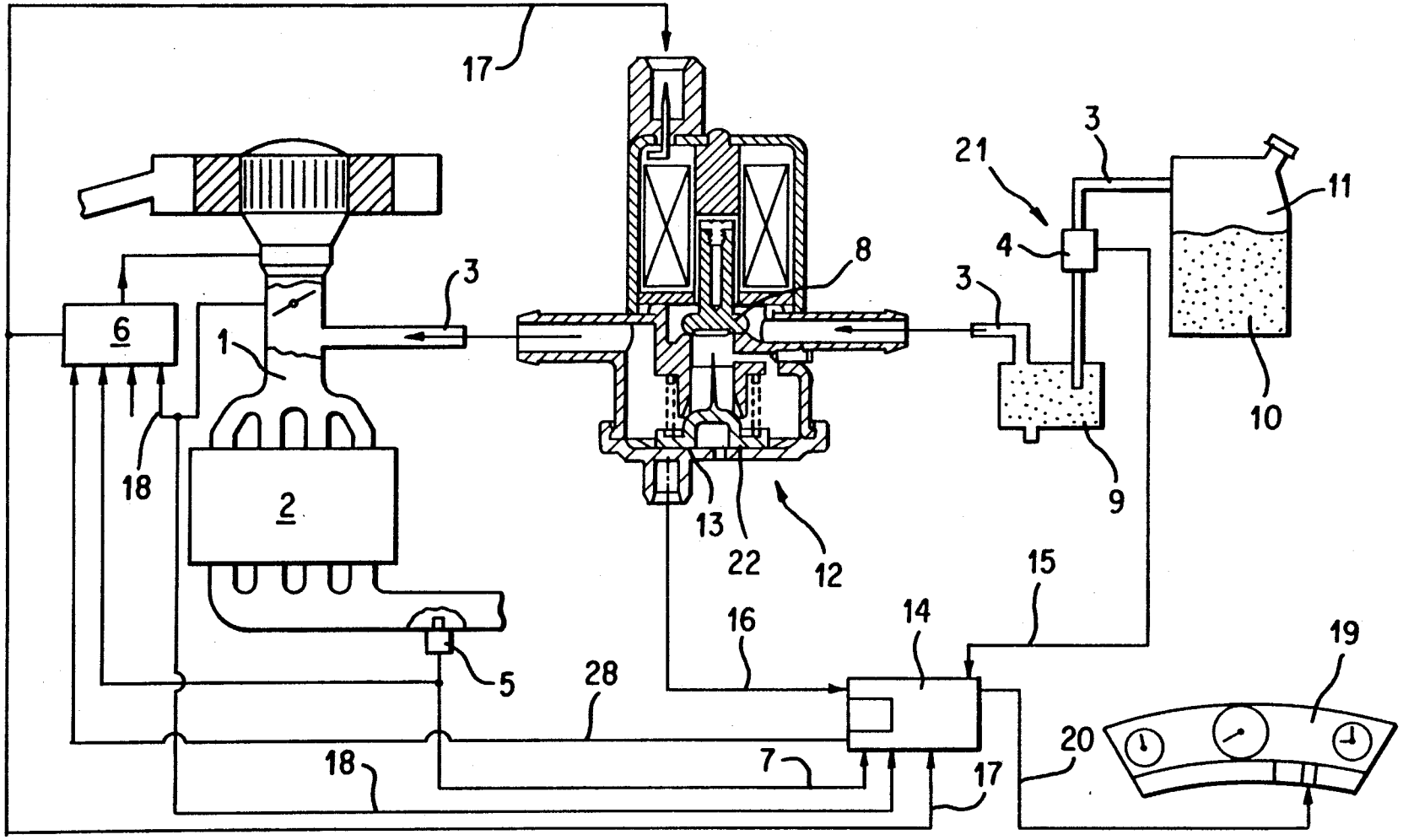
FIG. 1 is a partial diagrammatic representation of the system in which the invention operates.

Referring to FIG. 1, the diagnosis block 14 to which data from the engine 2 are transmitted is connected so as to carry signals to a vacuum actuator 12 which is preceded by the servo valve 8. The vacuum actuator 12 is provided with a sensor 13 and is configured as a switch. Furthermore, a tank venting valve 21 for controlling the rate of flow of volatile fuel components through the line 3 is disposed between the free space 11 of the tank system 10 and the servo valve 8. The pressure level between the absorption element 9 and the induction tube 1 of the engine 2 is determined by the vacuum actuator 12. The servo valve 8 generally remains open while the engine is operating, as described in U.S. Pat. No. 4,901,702.

The operation of the apparatus is explained as follows: The engine 2 is running at a certain loading, for example in the full-load condition or the idling condition. The loading is communicated to the diagnosis block 14 by a signal 18. The loading can be detected for example by the rotatory speed or by the position of the throttle valves. The diagnosis block 14 is furthermore connected with a control unit 6 to provide a signal 28 for the correct operation of the servo valve 8. The control unit 6 communicates information to the diagnosis block 14 as to whether and in what manner the servo valve 8 is actuated by a signal 17. Both the loading of the engine 2 and the position of the servo valve 8, which are described by the two signals 17 and 18, display the required state. This is compared with the current state which is input to the diagnosis block 14 by the signal 15 from the first sensor 4 in the tank venting valve 21 and by signal 16 from the vacuum actuator 12. Furthermore, the signal 7 presented by the lambda probe 5 is taken as the current value of the exhaust gas composition for comparison to a desired value in the microprocessor. If an arbitrary threshold value describing the deviation between the current value and the desired value is exceeded, an error display will be produced by the output signal 20 on an instrument 19 which is connected in a signal carrying manner to the diagnosis block.

The control unit 6 may be understood as an electronic control which outputs signals for control of engine operating parameters such as the fuel injection and ignition timing. For example, the deviation between the exhaust gas composition determined by the lambda probe 5 and the desired value can be used to vary the ignition timing so that optimum efficiency of catalytic exhaust gas purification is obtained. This, of course, could bring the deviation within the desired tolerance, so that the error display is avoided.

In order to assure reliable control of the vacuum actuator 12 in the arrangement herein described, the use of a known electronic circuit is proposed, which by evaluating the signal 16 can produce a go or no-go signal. The inputs which can be used for evaluation in this case could be current, voltage or inductance. To monitor the apparatus in the area between the tank system 10 and the absorption element 9, which contains active carbon, a tank venting valve 21 usually used in the closed venting system of the tank system 10 is modified so that the signal 15 which it puts out will be preferably an opening and closing signal. If the tank venting valve 21 is opened, fuel vapors are vented into the absorption element 9 and, if the entire system is properly operating, they are fed into the induction tube 1 of the engine 2.

With the system that has been set forth, it is possible in the electronic controls, by means of logical combinations through the diagnosis block 14, to detect in a reliable and repeatable manner, with the input signals 15, 16, 17 and 18 and 7, not only possible irregularities and defects in the system for the controlled feeding of volatile fuel components, but also faults in the rest of the system. With this system the area from the tank system 10 to the induction tube 1 can be monitored and controlled. For example, faults and defects in the servo valve 8, malfunctions in the vacuum actuator 12, faulty operation of the servo valve 8 due, for example, to open contacts, clogging in line 3 preceding and following the servo valve 8, erroneous line connections due for example to confusion of the connections, and line interruptions, can be detected.

An important advantage of the invention is that no expensive and delicate sensing system is used, and the greatest possible use is made of signals that are available, and control can be exercised by a simple modification of components available in the system. By using components that are already in use and have been tried and found effective the reliability of the operation of such a system is substantially improved, so that the time required for its incorporation is short and the upgrading cost for the user of the system can be considered to be extremely low.

Figure 2:
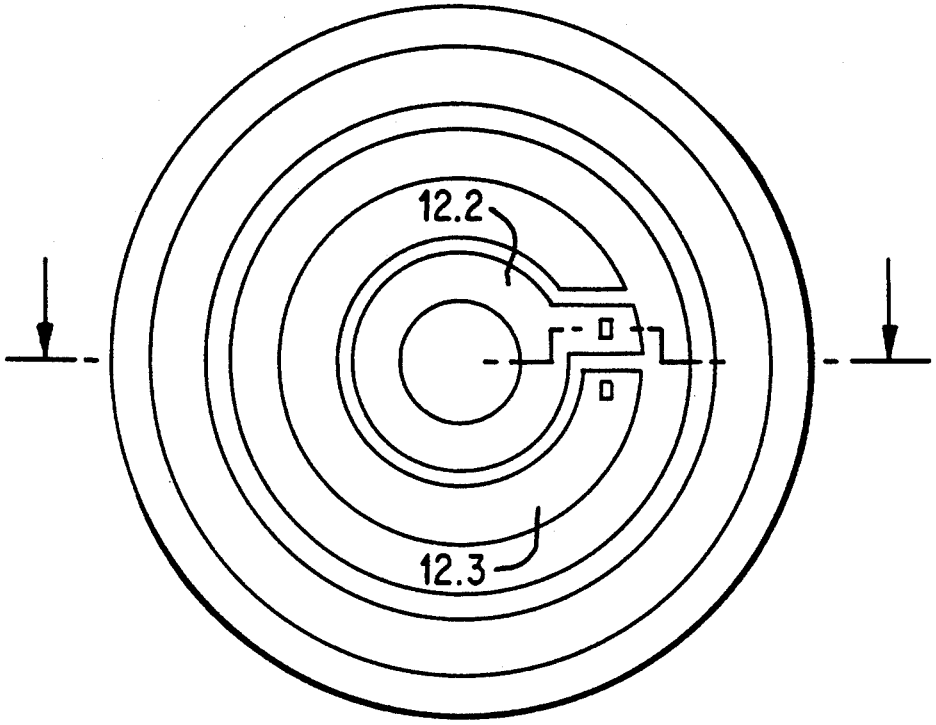
FIG. 2 is a plan view of the electrically conductive diaphragm and contacts.
Figure 2A:
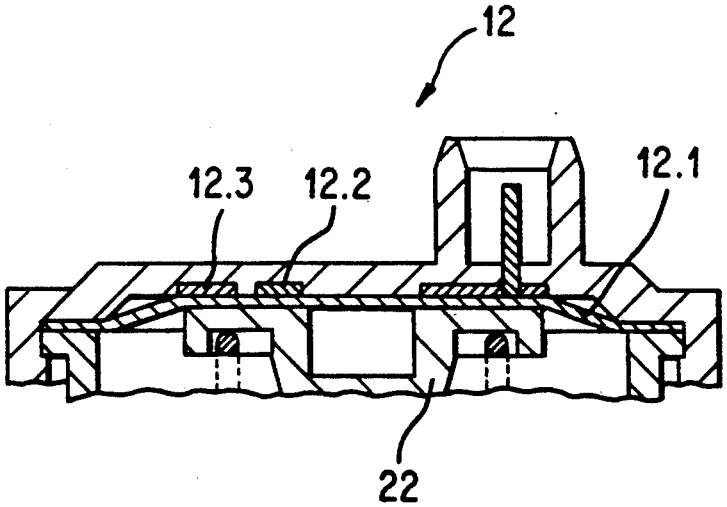
FIG. 2*a* is a partial section view of the vacuum actuator.

FIGS. 2 and 2*a* show the vacuum actuator 12 which is installed downstream of the servo valve 8. An electrically conductive diaphragm 12.1, through contacts 12.2 and 12.3, sends information on the position of the needle of the vacuum actuated valve 22 to the diagnosis block 14.

Figure 3:
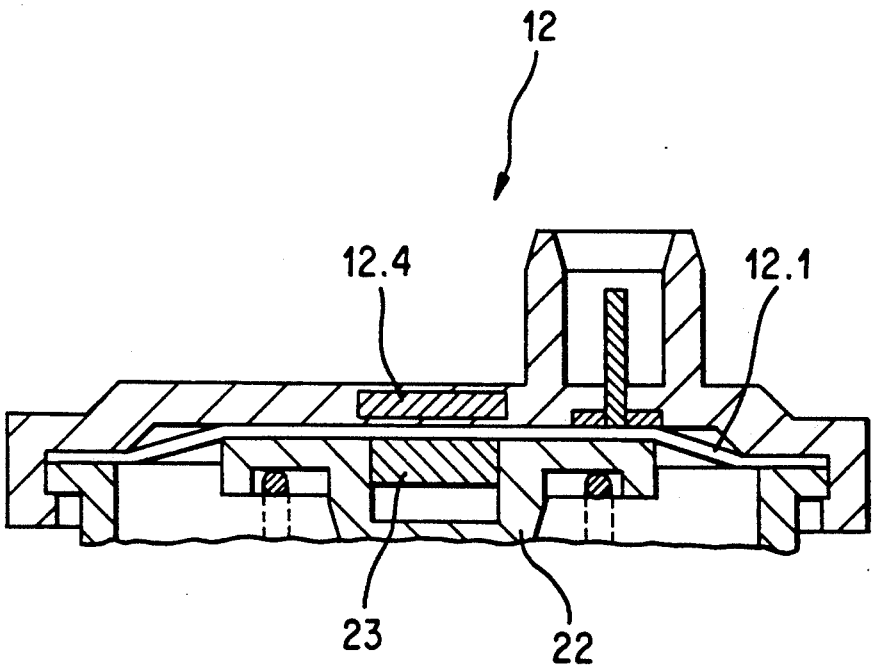
FIG. 3 is a partial section view of an alternative vacuum actuator.

Better signal resolution, however, is obtained by using the vacuum actuator 12 represented in FIG. 3, which is placed ahead of the servo valve 8 and in which a Hall element 12.4 is used, the needle of the vacuum actuated valve 22 forming the holder for the necessary permanent magnet 23. The Hall element 11 is provided with the necessary connections to read the emf induced by the proximity of the magnet 23, thereby indicating the position of the valve 22.

Figure 4:
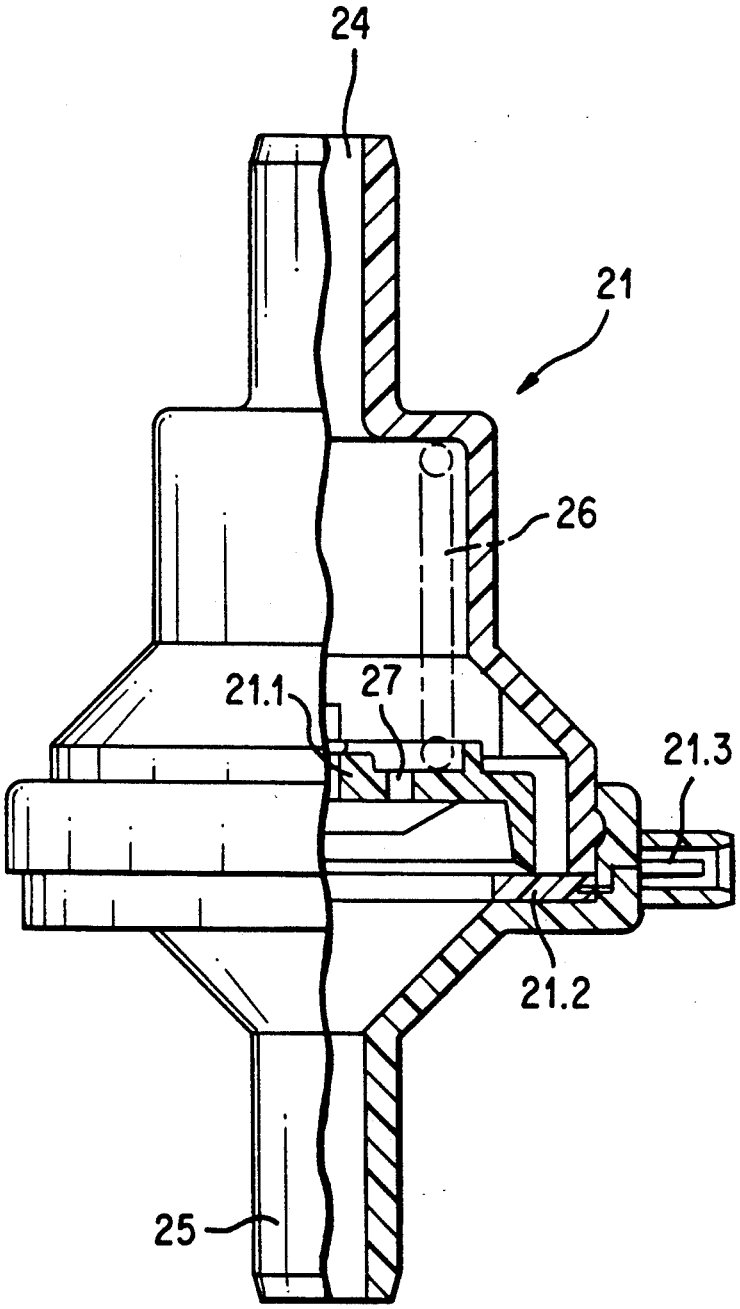
FIG. 4 is a partial section view of the tank venting valve according to the invention.

FIG. 4 shows a tank venting valve 21 as provided for the apparatus according to the invention. In it, a plastic valve plate 21.1 carrying an electrical contact is urged by a spring 26 against a valve seat 21.2 in the form of an elastomer sealing disk on which electrical contacts are mounted. The tank venting valve 21 has an electrical contact output terminal 21.3 which, as shown in FIG. 1, is connected to carry the signal 15 to the diagnosis block 14. The diagnosis block 14 thus receives information on the state of the operation of the tank venting valve 21. This may be simply an indication of whether the valve is open or closed, or (as in the embodiment of FIG. 3) an indication of the exact position of the valve plate. The connection 24 goes to to the absorption element 9 of FIG. 1, while connection 25 goes to the head space 11 of the tank 10. Moreover, in the tank venting valve 21 there is provided a low-pressure safety valve in the form of a mushroom diaphragm which opens a passage through the tank venting valve 21 at a critical low pressure downstream of the valve 21. The mushroom valve may be inserted in the aperture 27 through the plate 21.1 (this aperture is not present when a mushroom valve is not provided).

We claim:

1. Apparatus for the temporary storage and controlled feeding of volatile components in the free space of a fuel tank to the intake tube of an internal combustion engine, comprising a line from said free space to said intake tube, an absorption element between said free space and said intake tube, first sensing means for detecting gas flow between said free space and said absorption element and generating a first signal indicative of said flow, a servo valve between said absorption element and said intake tube, control means which generates a signal for controlling said servo valve, a vacuum actuated valve between said absorption element and said intake tube, second sensing means for detecting the position of said vacuum actuated valve and generating a second signal indicative of said position, and diagnosis means for comparing said first and second signals to said signal controlling said servo valve and generating an error signal when a fault is diagnosed.

2. Apparatus as in claim 1 wherein said diagnosis means generates a signal to said control means as an input for said control means to generate said signal for controlling said servo valve.

3. Apparatus for the temporary storage and controlled feeding of volatile components in the free space of a fuel tank to the intake tube of an internal combustion engine, comprising a line from said free space to said intake tube, an absorption element between said free space and said intake tube, first sensing means for detecting gas flow between said free space and said absorption element and generating a first signal indicative of said flow, a servo valve between said absorption element and said intake tube, control means which generates a signal for controlling said servo valve, a vacuum actuated valve between said absorption element and said intake tube, second sensing means for detecting the position of said vacuum actuated valve and generating a second signal indicative of said position, and diagnosis means for comparing said first and second signals to said signal controlling said servo valve and generating a signal to said control means as an input for said control means to generate said signal for controlling said serve valve.

4. Apparatus as in claim 3 wherein said diagnosis means generates an error signal when a fault is detected.

* * * * *